US008021238B2

(12) United States Patent
White

(10) Patent No.: US 8,021,238 B2
(45) Date of Patent: Sep. 20, 2011

(54) MIRROR IMAGE DISPLAY METHOD

(76) Inventor: Franklin Ralph White, Randleman, NC (US)

( * ) Notice: Subject to any disclaimer, the term of this patent is extended or adjusted under 35 U.S.C. 154(b) by 83 days.

(21) Appl. No.: 12/460,520

(22) Filed: Jul. 21, 2009

(65) Prior Publication Data

US 2010/0020425 A1 Jan. 28, 2010

Related U.S. Application Data

(60) Provisional application No. 61/083,463, filed on Jul. 24, 2008.

(51) Int. Cl.
*A63G 31/00* (2006.01)
*G09F 19/08* (2006.01)

(52) U.S. Cl. ..... 472/63; 40/411

(58) Field of Classification Search ..... 472/61, 472/63, 72, 74; 40/411, 427, 596
See application file for complete search history.

(56) References Cited

U.S. PATENT DOCUMENTS

| | | | | |
|---|---|---|---|---|
| 1,140,148 | A * | 5/1915 | Furber | 40/418 |
| 2,607,142 | A * | 8/1952 | Lee | 40/596 |
| 6,338,884 | B1 * | 1/2002 | Chang | 428/13 |
| 6,929,552 | B1 * | 8/2005 | Hargabus | 472/61 |

* cited by examiner

*Primary Examiner* — Kien Nguyen

(57) ABSTRACT

The mirror image display method is used to suspend the main subject of a decorative or presentation display in mid air. This is accomplished by affixing the flat side of a symmetrically divided main subject flush onto a true first-surface mirror, which makes up one wall of the display body and eliminates the subjects visible seam line.

2 Claims, 10 Drawing Sheets

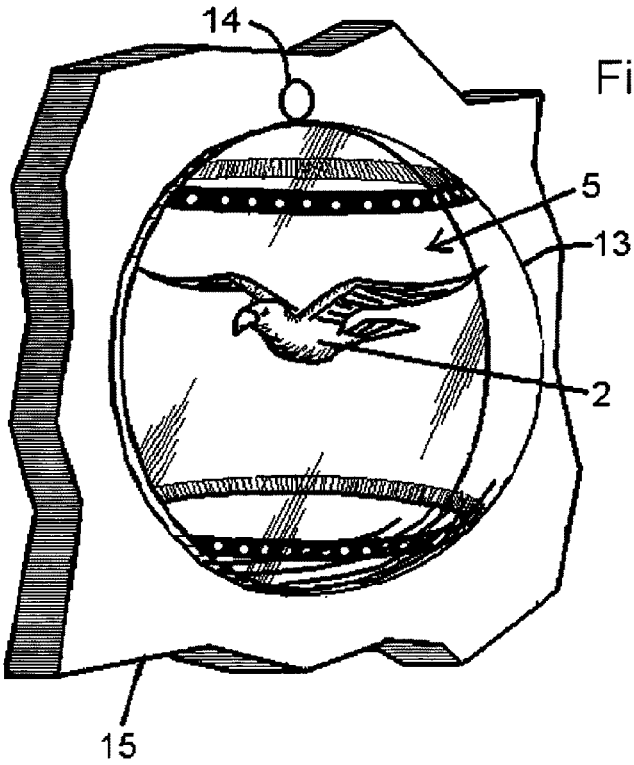
Fig. 16
Fig. 17
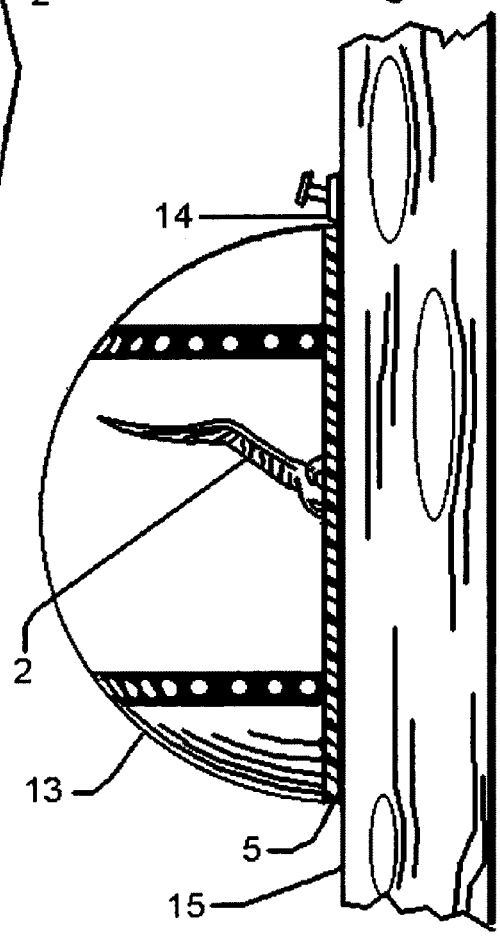

MIRROR IMAGE DISPLAY METHOD

CROSS-REFERENCE TO RELATED APPLICATIONS

References Cited

U.S. Patent Documents

US20080146356A1 December 2006 Gaughan . . . Method and apparatus for producing optical illusions
US20050263463A1 May 2005 Fukuda . . . Three dimensional display device
U.S. Pat. No. 5,886,956 April 1998 Fiedler . . . Display for illusion of floating in the air
U.S. Pat. No. 6,278,419 June 1997 Malkin . . . Moving display
U.S. Pat. No. 5,782,547 November 1996 Machtig . . . Magnified background image spatial object
U.S. Pat. No. 5,685,625 April 1996 Beaver . . . Apparatus and method for creating optical
U.S. Pat. No. 5,346,433 February 1993 Weinreich . . . Mirror illusion
U.S. Pat. No. 4,971,312 May 1989 Weinreich . . . Illusion apparatus
U.S. Pat. No. 4,802,750 August 1987 Welck . . . Real image projection system with two curved
U.S. Pat. No. 4,475,126 August 1982 Akins . . . Visual image display apparatus
U.S. Pat. No. 4,273,418 November 1979 Gillespie . . . Mirror for producing optical illusions
U.S. Pat. No. 4,261,657 August 1978 Reiback . . . Optical display device The method of the present invention achieves the illusion of floating a display's centerpiece entity in a fashion not sighted in the prior art.

STATEMENT REGARDING FEDERALLY SPONSORED RESEARCH OR DEVELOPMENT

"Not Applicable"

REFERENCE TO SEQUENCE LISTING, A TABLE, OR A COMPUTER PROGRAM

Listing Compant Disc Appendix

"Not Applicable"

BACKGROUND OF THE INVENTION a. Field of Invention

The present invention relates to a method of creating a setting for the centerpiece of a business, home, or personal display; more particularly, a wall panel, plaque, desk top, or ornament display.

b. Description of the Prior Art

Through thorough research, combined with information gathered from an official patent search conducted on Jun. 27, 2008, no reference to the method of the present invention was found.

BRIEF SUMMARY OF THE INVENTION

By way of brief summary, the principal object of the present invention is to provide a method of creating a display setting where the centerpiece entity appears to float unsupported within the boundaries of the display.

The above object is accomplished by attaching a symmetrical half-centerpiece entity to a polystyrene or mailable first-surface quality mirror so the seam line of said entity is perfectly flush against the mirror surface, which renders the seam line invisible due to the mirror's reflective material being 100% on the surface, causing the half-entity to appear whole and embedded within the reflective void, The method of the present invention can also expand a display's functionality by making it possible to create a convincing two, three, and four spatial dimensional display setting by means of the first-surface mirror's reflective properties on the surrounding components of said display, as well as visually expanding the display area without consuming additional space.

BRIEF DESCRIPTION OF THE SEVERAL VIEWS OF THE DRAWING

FIG. 16 illustrates a perspective view of the wall-ball display variation using a bird as the centerpiece entity, which demonstrates the illusion that half the ball is embedded in a wall or sign panel.

FIG. 17 illustrates a sectional view of the wall-ball display variation.

DETAILED DESCRIPTION OF THE PREFERRED EMBODIMENTS

This application claims the benefits of Provisional Application No. 61/083,463 filed on 24 Jul. 2008.

The method of the present invention is defined as the flat side of a symmetrical-half centerpiece entity being attached onto a first-surface mirror in such a manner as to cause the seam line to be perfectly flush against the mirror, which renders the seam invisible, thus making the half-entity appear whole due to it's seamless reflection and embedded within the reflective void.

The two required components for making the illusion viable regardless of the display's genre are a symmetrical-half centerpiece entity having a perfectly flush seam line, and a true first-surface mirror that is embossed on a polystyrene sheet to enable drilling attachment holes for a heavier entity, or, in the case of utilizing a lighter entity, a glass or metallic first-surface mirror will suffice because the entity can be attached with glue. The entity can be a scaled down representation of anything that can be divided into two symmetrical sides including human or cartoon figures, animals, birds, fish, reptiles, sci-fi vehicles, airplanes, airships, space ships, submarines, flowers, rings, bottles, glasses, some musical instruments, planets, parachutes, hot air balloons, balls, helmets, trophies, tires, medals, coins, et cetera.

Figure 1:
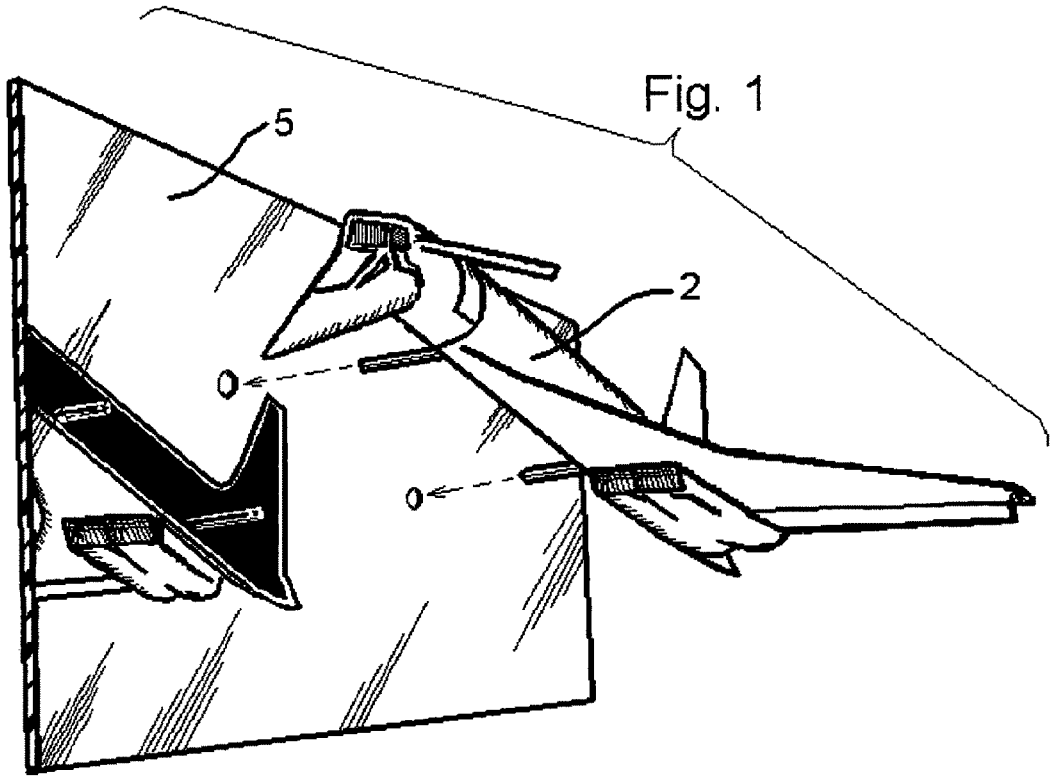
FIG. 1 illustrates an exploded view of the two necessary components for accomplishing the method of the present invention.
Figure 2:
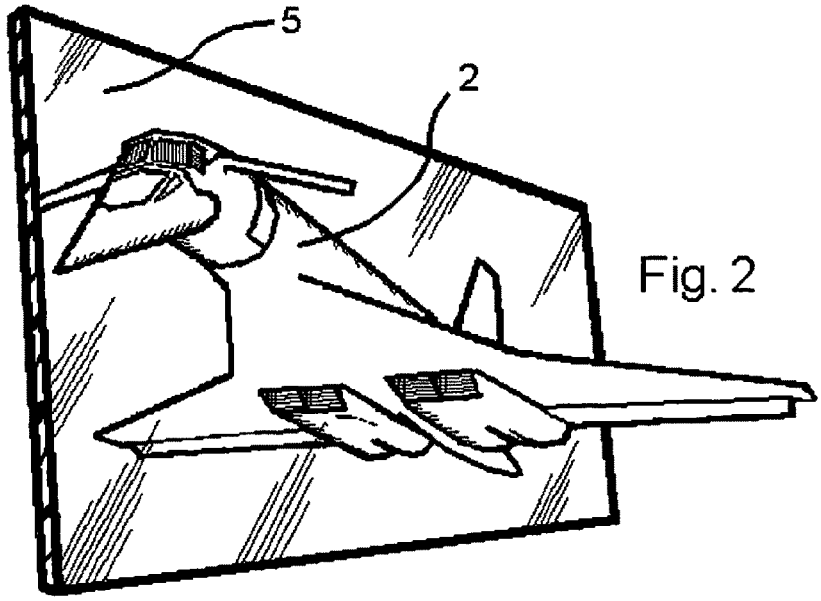
FIG. 2 illustrates the seamless connection between the centerpiece entity and the mirror due to said mirror's first surface qualities.

First of all, refer to FIG. 1 of the drawings which illustrates an exploded view of the components necessary to accomplish the method of the present invention, showing the symmetrically split centerpiece entity 2, a model airplane in this example, as it appears before it is attached to the first-surface mirror 5. FIG. 2 illustrates the seamless reflection created after attaching the airplane entity 2 onto a first-surface mirror 5. We will now explore the method in depth.

Figure 3:
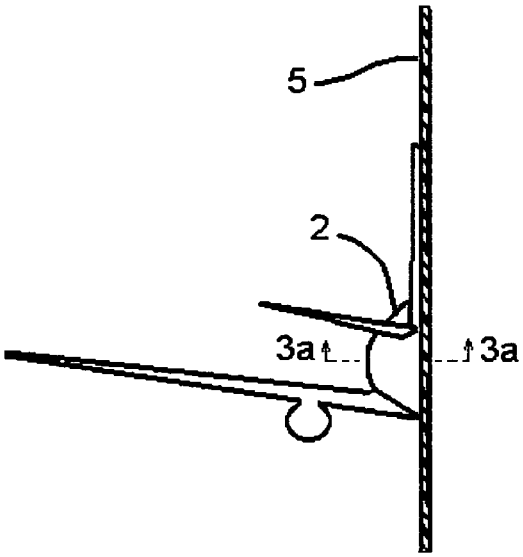
FIG. 3 illustrates an elevation view of the centerpiece entity attached to the first surface mirror sheet.
Figure 4:
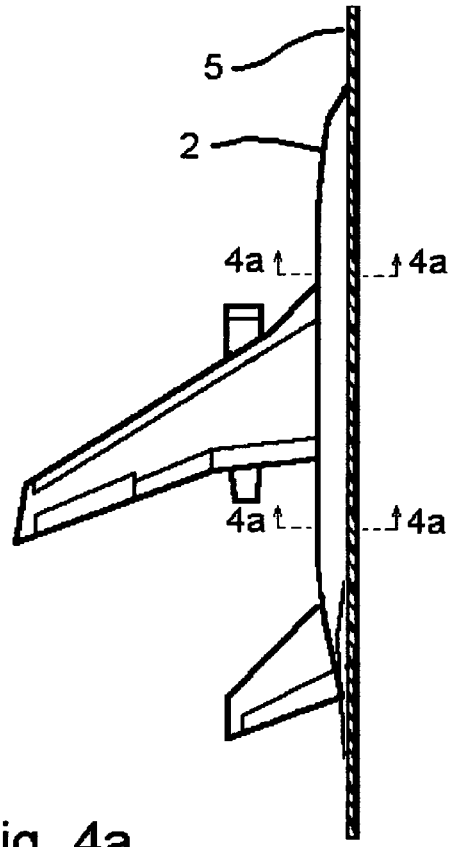
FIG. 4 illustrates an plan view of the centerpiece entity attached to the first surface mirror sheet.

Referring to FIG. 3 and FIG. 4 of the drawings, we see how the centerpiece entity, a half plastic model airplane 2 in this example, is affixed flat onto the mirror surface 5, which is best accomplished using two tubular plastic rods that are glued inside the fuselage half at 50% of the its breadth as indicated in FIG. 3, position 3*a*- -3*a*, and at 25% and 75% of its length as indicated in FIG. 4, position 4*a*- -4*a*.

Figure 3A:
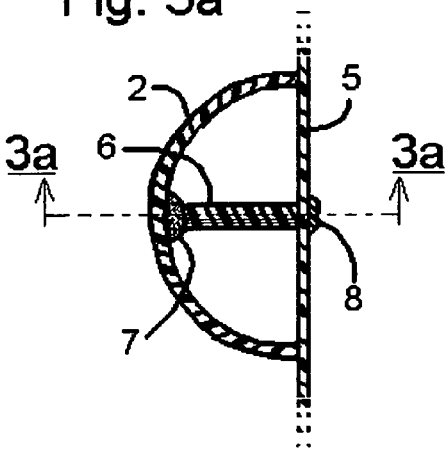
FIG. 3*a* illustrates a cross section view of 3*a*- -3*a*, showing the entity attachment mechanism.
Figure 4A:
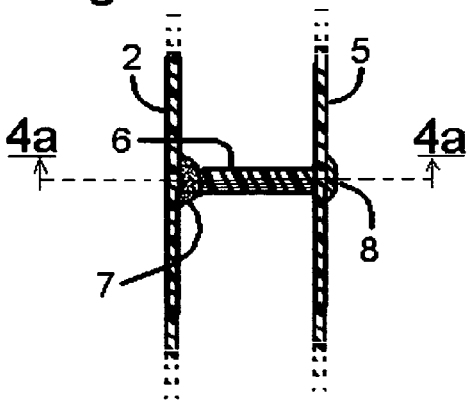
FIG. 4*a* illustrates a cross section view of 4*a*- -4*a*, showing the entity attachment mechanism.

Illustrated in cross section views FIG. 3*a* and FIG. 4*a*, where 2 is the body of the fuselage and 5 is the mirror surface, the plastic rods 6 are glued into position using a cold weld compound 7, making sure they are ninety degrees to the entity's seam line, and dry 24 hours. Once dry, the entity is held to the mirror and marks are made where the rod ends touch, then holes are drilled through the mirror at these marks.

Hold the entity 2 up to the mirror 5 and slide the ends of the plastic rods into the drilled holes, then hold it firmly against the mirror 5 and melt the rod ends 8 onto the polystyrene mirror back 5 with a heat spatula. Please note, for a heavier centerpiece entity attachments, glue the mirror sheet to a homogeneous section of wood and substitute the plastic rods with machine bolts, secured by nuts to the back of the wooden panel.

Figure 5:
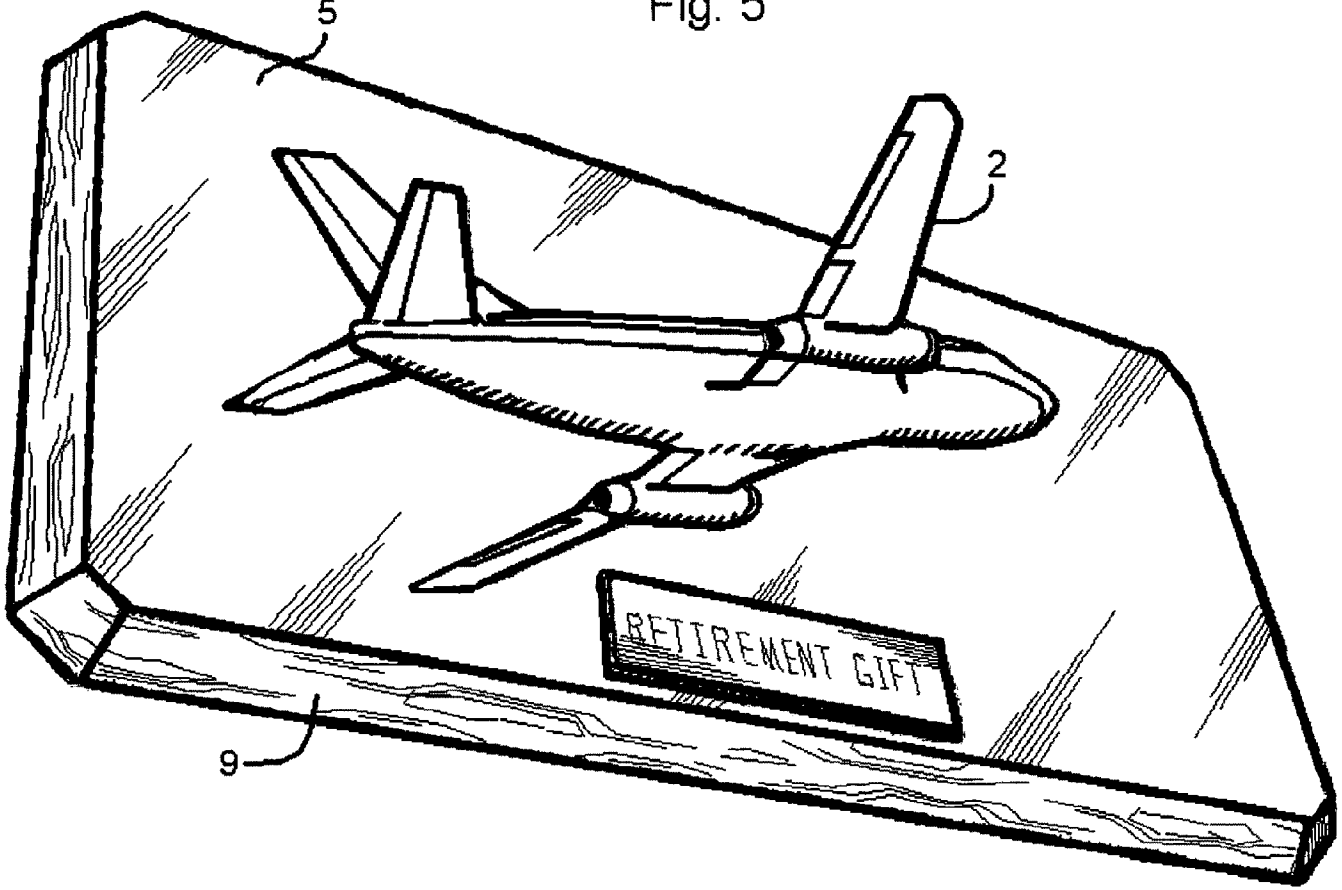
FIG. 5 illustrates a down to up perspective of an assembled plaque display variation.
Figure 6:
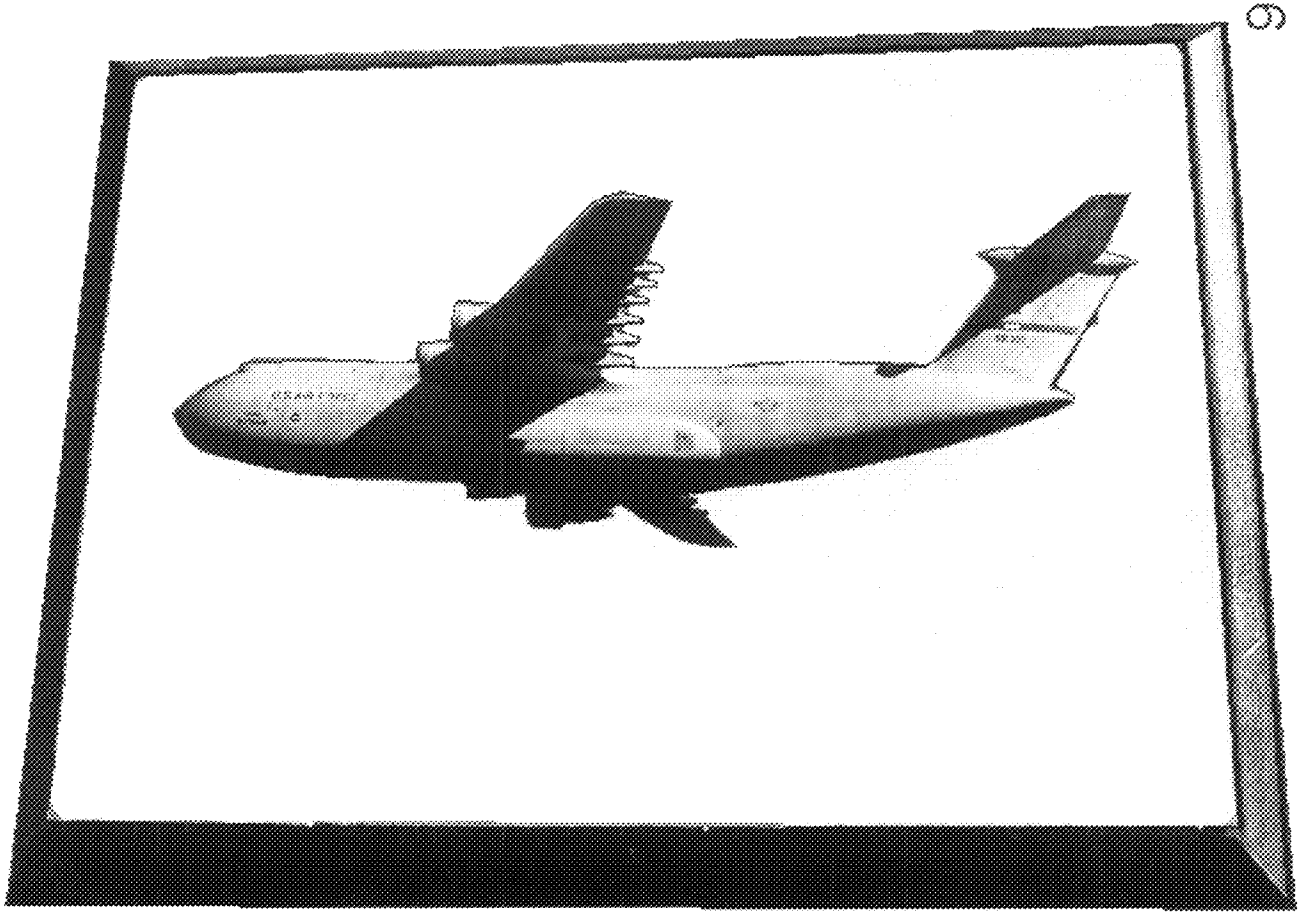
FIG. 6 is a black and white photograph that better demonstrates the two spatial dimensional quality of the plaque display variation.

This process creates unique wall panel and plaque display opportunities using the method of the present invention, such as illustrated in FIG. 5, which offers a perspective view of the wooden plaque 9 and first-surface mirror 5 with the centerpiece entity 2 seemingly embedded within the reflection. The two spatial dimensional qualities can be better visualized by referring to FIG. 6.

Figure 7:
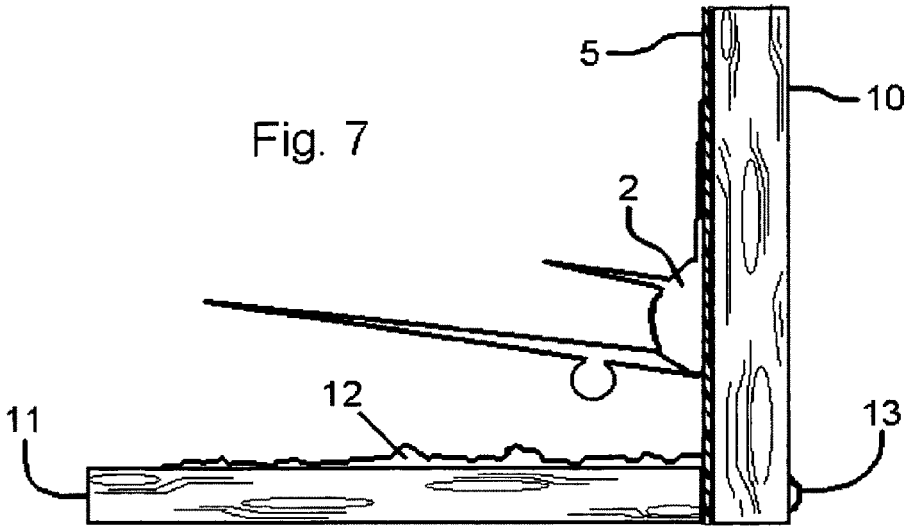
FIG. 7 illustrates an elevation view of a desk top display variation.

Now we will move on to FIG. 7 which illustrates the desk-top or shelf-top display variation where the method of the present invention actually marries two scenes together creating a three spatial dimensional effect. After the first-surface mirror 5 and centerpiece entity 2 are in place on a back board 10, attach a horizontally inclined base board 11 to the lower edge of the vertically inclined back board 10 by means of two wood screws 13 near each of the lower corners. Now add a diorama ground or water surface 12, or even a picture, to the upper surface of the base board 11, making sure that the back edge of the diorama or picture is flush against the mirror surface 5

Figure 8:
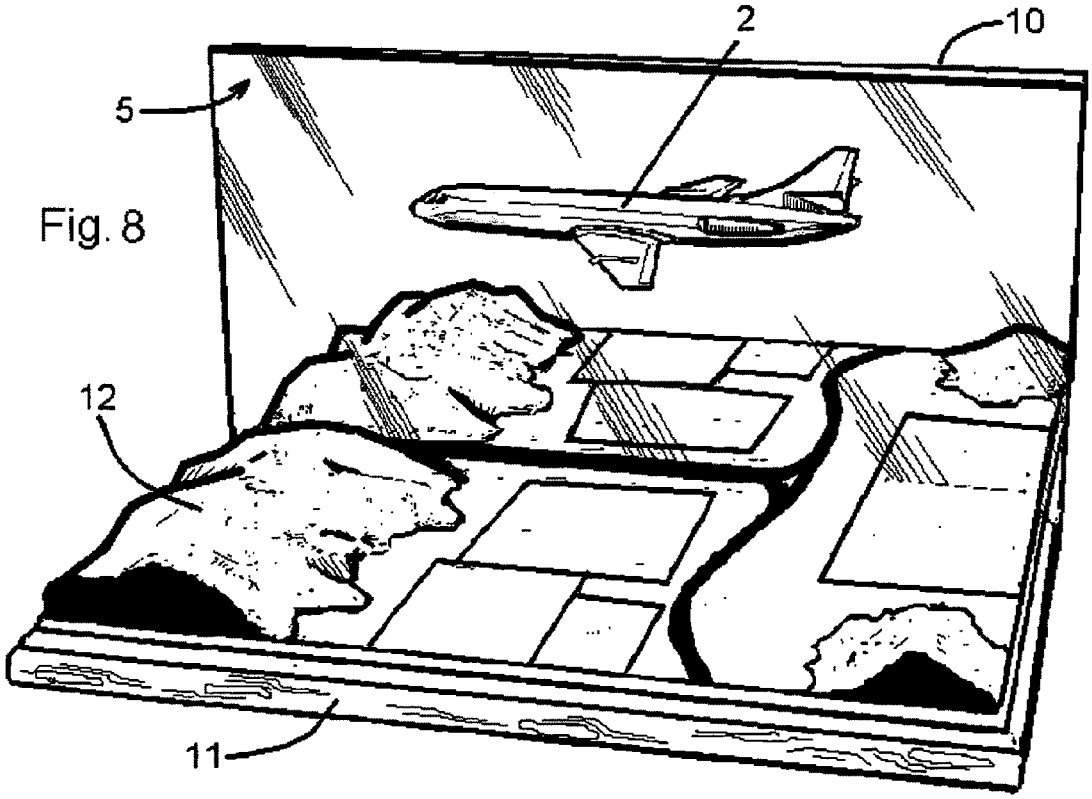
FIG. 8 illustrates a perspective view of a desk top display variation.

In FIG. 8, we see a perspective illustration of the three spatial dimensional vista, which reflects the diorama scene 12 and the airplane entity 2 in the mirror 5, simply by adding a base board 11 to the assembled back board 10.

Figure 9:
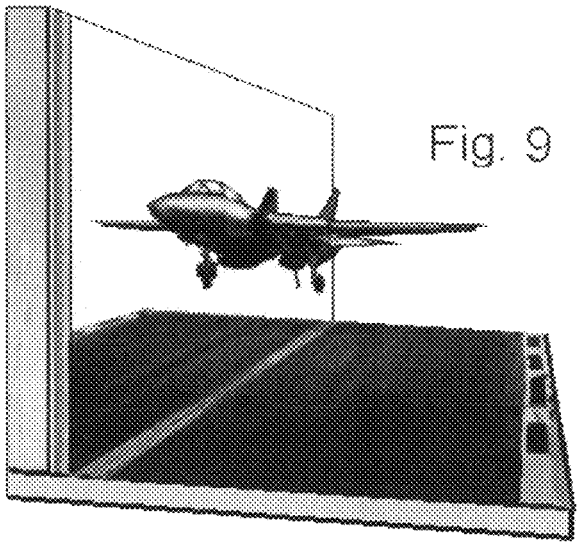
FIG. 9 is a black and white photograph that better demonstrates the three spatial dimensional qualities created by the desk top display variation.
Figure 10:
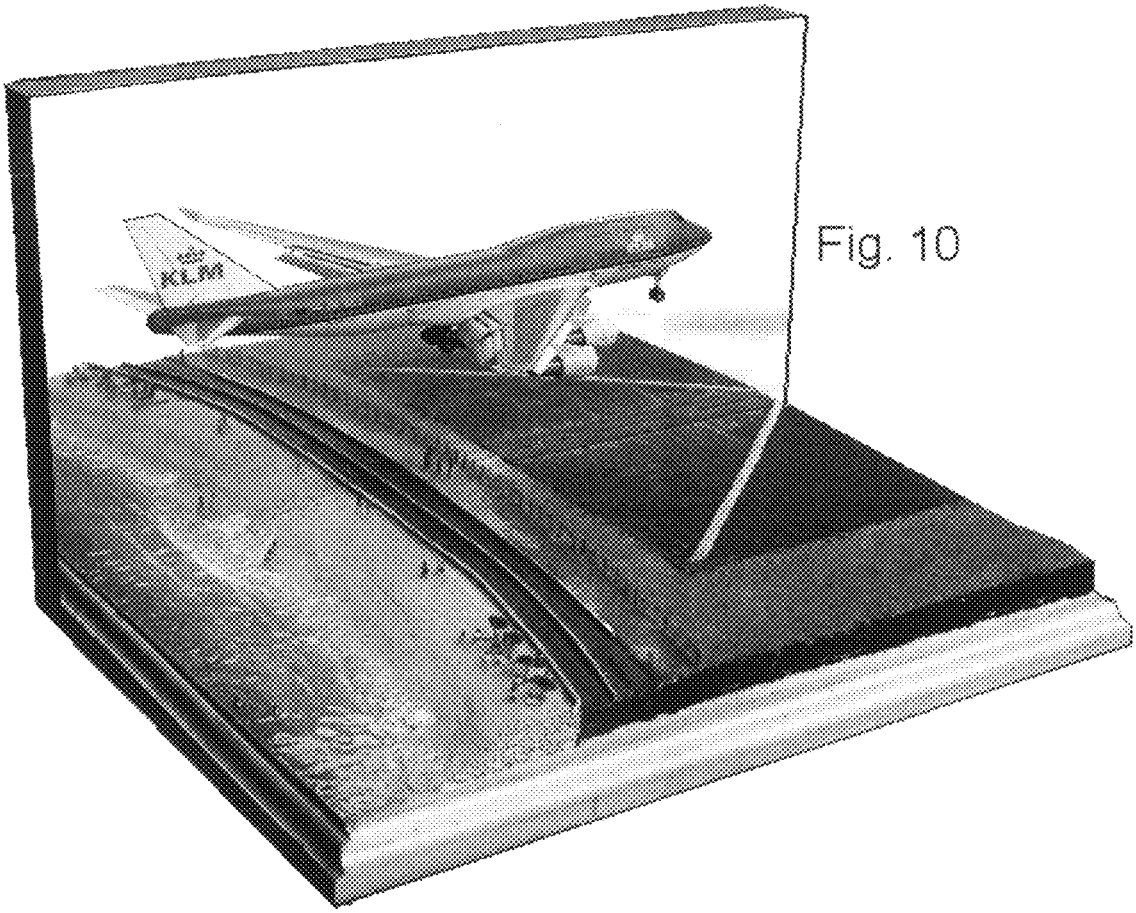
FIG. 10 is a black and white photograph of an assembled desk top display which better demonstrates the single entity and scene illusion created by using the method of the present invention.

The visual effect the method of the present invention creates on a desk-top or shelf-top display application can be better understood by referencing FIG. 9 and FIG. 10, where the seamless reflection tricks the eyes into believing there's a complete scene before them with an airplane floating above it.

Figure 11:
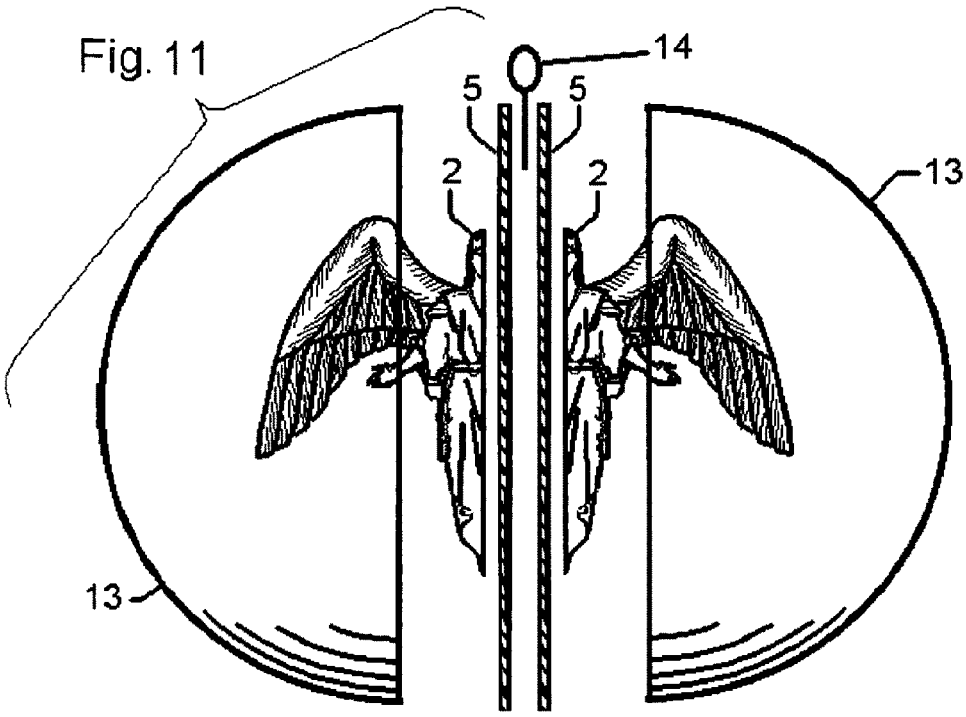
FIG. 11 illustrates an exploded view of the dual-side display variation as used in an ornament with an Angel figure as the centerpiece entity.
Figure 12:
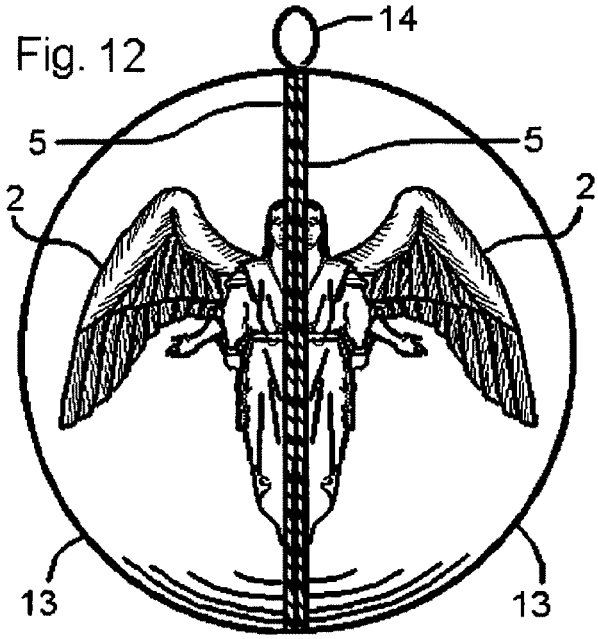
FIG. 12 illustrates a sectional view of the dual-side display variation as used in an ornament.
Figure 13:
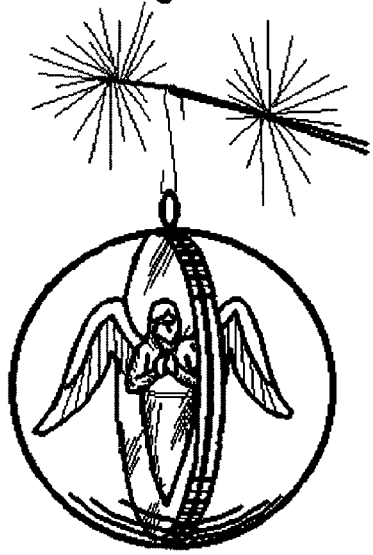
FIG. 13 illustrates a perspective view of an assembled dual-side display variation in a Christmas tree ornament.

The illusion generated by the method of the present invention is not only restricted to two and three dimensional displays, but also capable of producing a convincing fourth spatial dimension within an enclosed ornament display as outlined in the exploded view of FIG. 11, as well as FIG. 12, and FIG. 13 of the drawings, where two circular sections 5 the exact same diameter are carefully cut from a first-surface mirror sheet, then make an attachment ring 14 from a length of thin nylon string.

Place the ends of the string on the back of one of the mirrors so the ring 14 hangs over the edge and glue both mirrors 5 together, back to back, with the string ends sandwiched between them. The exposed string ring 14 becomes the top.

Now get a symmetrically split entity, an Angel in this example, and glue each half 2 to the center of each mirror 5, as illustrated in the exploded view of FIG. 11. Then using a two piece acrylic ball, 13, which is slightly larger than the diameter of the mirrors 5, enclose the mirrored assembly within the ball by gluing the left side to the right side. Once assembled, you can see in FIG. 12 how components 5 and 2, and 13 are joined, with the nylon ring 14 protruding from the top. The assembly is seen in a perspective view in FIG. 13 which illustrates how the mirror reflects its individual side, ball and entity, which directly correlates with the opposite side entity.

Figure 14:
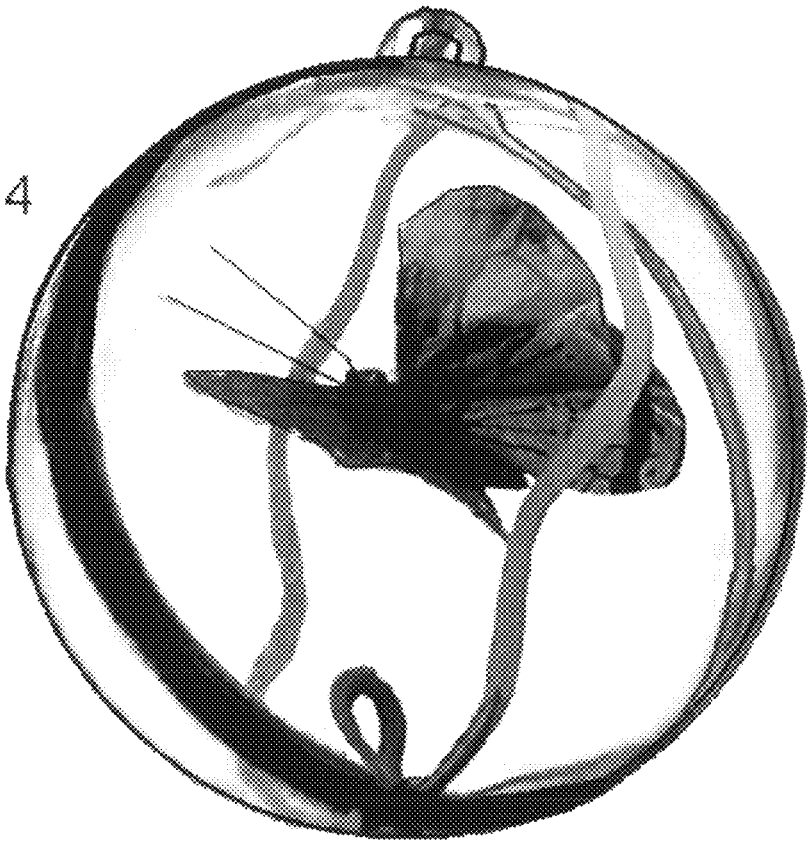
FIG. 14 is a black and white photograph that better demonstrates the four spatial dimensional qualities of the dual-side display method of the present invention, with an Angel centerpiece entity.
Figure 15:
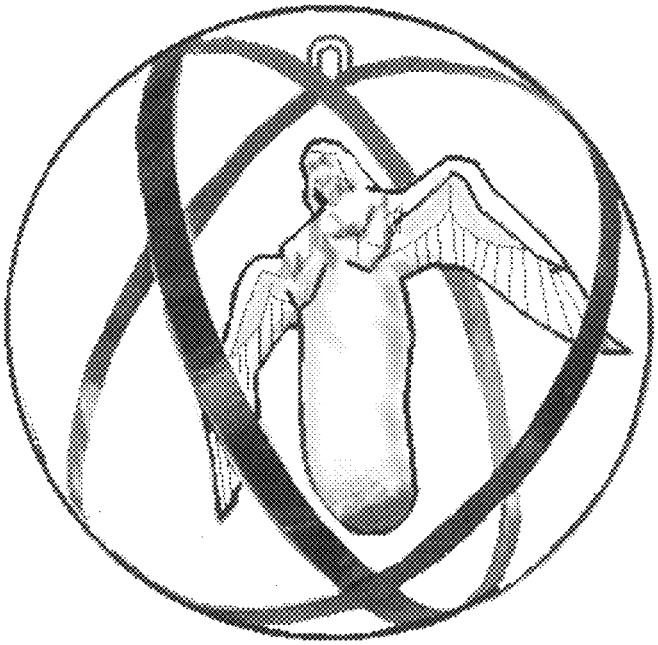
FIG. 15 is a black and white photograph that even better demonstrates the four spatial dimensional qualities of the dual-side display using the method of the present invention, with a butterfly centerpiece entity.

The fourth spatial dimensional qualities created by the method of the present invention in the dual-side ornamental display variation is better represented in FIG. 14 and FIG. 15, which convinces the visual senses the entity is free-floating within the sphere regardless of what perspective it is viewed.

In addition, decorative interior ornamental wall-ball displays can be created using the method of the present invention. Please reference FIG. 16 and FIG. 17, which illustrates a perspective and elevation view respectively, showing a half acrylic ball 13 which has been glue to a circular cut first surface mirror section 5 with the centerpiece entity 2, which is a symmetrical half bird in this example, glued in the center, as well as the attachment ring 14 which is glued to the back of the mirror section, and hung on a wall 15.

Figure 18:
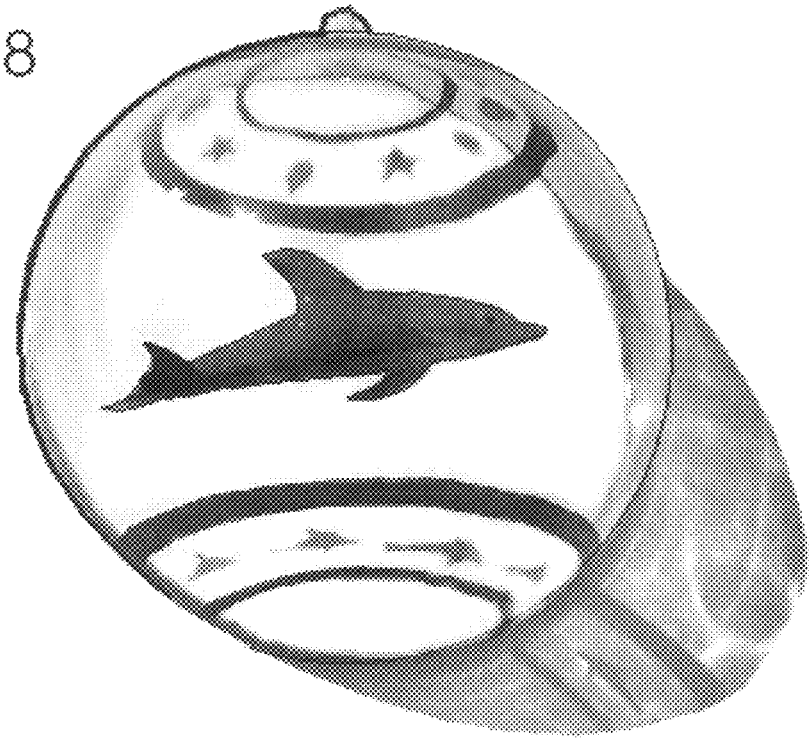
FIG. 18 is a black and white photograph that better demonstrates the illusion created by the wall-ball display variation, with a dolphin figure as the centerpiece entity, and set against a white wall.
Figure 19:
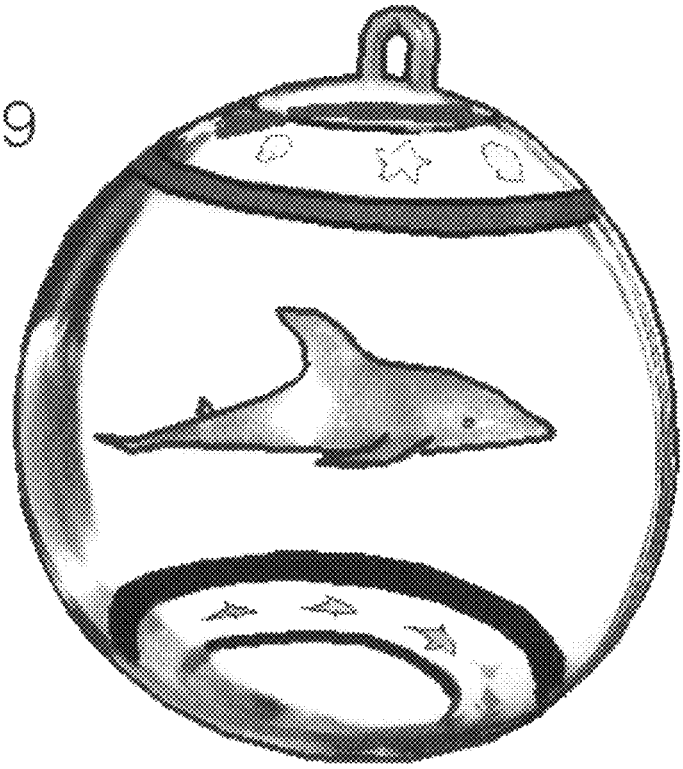
FIG. 19 is a black and white photograph that better demonstrates the illusion created by the wall-ball display variation, with a dolphin figure as the centerpiece entity, and set against a wood grain wall.

The visual effect the method of the present invention creates on a wall-ball display variation can be better understood by referencing FIG. 18 and FIG. 19, which demonstrates how the half-acrylic ball appears to be whole and embedded within the wall, or sign surface, with the centerpiece entity, a dolphin in this example, floating in the center.

What is claimed is:

1. A method for making a centerpiece entity of a display appears to float within the boundaries of said display, comprising:

(a) providing said centerpiece entity with a symmetrically divided body of material, and said centerpiece entity having a flat side;

(b) providing two malleable or solid mirrors with first-surface reflective properties, and cutting the mirrors into two circular discs;

(c) providing means for attaching said centerpiece entity to said first-surface mirror;

(d) cutting said malleable first-surface mirror into two circular discs, attaching said two circular discs back to back with glue;

(e) attaching each symmetrical half of said centerpiece entity to the center of each side of said circular disc by said means for attaching so that the flat side is disposed flush thereby; and (f) enclosing said circular discs in a two-piece acrylic sphere so that said acrylic sphere's seam corresponds with the edges of said circular discs.

2. The method defined in claim 1, providing one of said circular discs, attaching one piece of the symmetrical divided centerpiece entity to the reflective side of said disc, and disposed to one half of said two piece acrylic sphere.

* * * * *